US008021811B2

(12) United States Patent
De Jong et al.

(10) Patent No.: US 8,021,811 B2
(45) Date of Patent: Sep. 20, 2011

(54) PHOTORECEPTOR AND METHOD OF MAKING SAME

(75) Inventors: Kathy L. De Jong, Mississauga (CA); Yu Qi, Oakville (CA); Vladislav Skorokhod, Mississauga (CA); Nan-Xing Hu, Oakville (CA); Johann Junginger, Toronto (CA); Markus Silvestri, Fiarport, NY (US); John F. Yanus, Webster, NY (US); Kenny-Tuan Dinh, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 911 days.

(21) Appl. No.: 12/018,523

(22) Filed: Jan. 23, 2008

(65) Prior Publication Data

US 2009/0186287 A1 Jul. 23, 2009

(51) Int. Cl.
*G03G 5/00* (2006.01)

(52) U.S. Cl. ..... 430/66; 430/132

(58) Field of Classification Search ..... 430/66, 430/132

See application file for complete search history.

(56) References Cited

U.S. PATENT DOCUMENTS

| | | | | |
|---|---|---|---|---|
| 3,121,006 | A | 2/1964 | Middleton et al. | |
| 4,457,994 | A | 7/1984 | Pai et al. | |
| 4,871,634 | A | 10/1989 | Limburg et al. | |
| 5,702,854 | A | 12/1997 | Schank et al. | |
| 5,976,744 | A | 11/1999 | Fuller et al. | |
| 2003/0194625 | A1 * | 10/2003 | Tanaka et al. | 430/58.8 |
| 2006/0105264 | A1 | 5/2006 | Dinh et al. | |
| 2007/0072101 | A1 | 3/2007 | Dinh et al. | |

FOREIGN PATENT DOCUMENTS

| | | | |
|---|---|---|---|
| EP | 1 172 702 | A1 | 1/2002 |
| EP | 1 324 141 | A1 | 7/2003 |
| EP | 1 808 732 | A1 | 7/2007 |

OTHER PUBLICATIONS

U.S. Appl. No. 11/295,134, filed Dec. 13, 2005.

* cited by examiner

*Primary Examiner* — Mark Chapman

(74) *Attorney, Agent, or Firm* — Oliff & Berridge, PLC

(57) ABSTRACT

Disclosed is an electrophotographic photoreceptor having a protective overcoat layer including a polyol binder; a hole transport material; a curing agent; and a surface-treated tin oxide particle filler. Also disclosed is a process for forming a photoreceptor that includes providing a photoreceptor substrate; applying a charge generating layer; applying a charge transport layer; and applying a protective overcoating layer over the substrate; such that the protective overcoat layer includes a polyol binder; a hole transport material; a curing agent; and a surface-treated tin oxide particle filler. Also included is a method of forming an image, including the disclosed photoreceptor.

22 Claims, 2 Drawing Sheets

PHOTORECEPTOR AND METHOD OF MAKING SAME

TECHNICAL FIELD

This disclosure is generally directed to electrophotographic imaging members and, more specifically, to layered photoreceptor structures comprising a protective overcoat layer containing a surface-treated tin oxide particle filler. This disclosure also relates to processes for making and using the imaging members.

REFERENCES

U.S. Pat. No. 5,702,854 describes an electrophotographic imaging member including a supporting substrate coated with at least a charge generating layer, a charge transport layer and an overcoating layer, said overcoating layer comprising a dihydroxy arylamine dissolved or molecularly dispersed in a crosslinked polyamide matrix. The overcoating layer is formed by crosslinking a crosslinkable coating composition including a polyamide containing methoxy methyl groups attached to amide nitrogen atoms, a crosslinking catalyst and a dihydroxy amine, and heating the coating to crosslink the polyamide. The electrophotographic imaging member may be imaged in a process involving uniformly charging the imaging member, exposing the imaging member with activating radiation in image configuration to form an electrostatic latent image, developing the latent image with toner particles to form a toner image, and transferring the toner image to a receiving member.

U.S. Pat. No. 5,976,744 discloses an electrophotographic imaging member including a supporting substrate coated with at least one photoconductive layer, and an overcoating layer, the overcoating layer including a hydroxy functionalized aromatic diamine and a hydroxy functionalized triarylamine dissolved or molecularly dispersed in a crosslinked acrylated polyamide matrix, the hydroxy functionalized triarylamine being a compound different from the polyhydroxy functionalized aromatic diamine. The overcoating layer is formed by coating.

U.S. patent application Ser. No. 11/234,275 filed Sep. 26, 2005, discloses an electrophotographic imaging member comprising a substrate, a charge generating layer, a charge transport layer, and an overcoating layer, said overcoating layer comprising a cured polyester polyol or cured acrylated polyol film-forming resin and a charge transport material.

U.S. patent application Ser. No. 11/295,134 filed Dec. 13, 2005, discloses an electrophotographic imaging member comprising a substrate, a charge generating layer, a charge transport layer, and an overcoating layer, said overcoating layer comprising a terphenyl arylamine dissolved or molecularly dispersed in a polymer binder.

U.S. patent application Ser. No. 10/992,913 filed Nov. 18, 2004, discloses a process for preparing an overcoat for an imaging member, said imaging member comprising a substrate, a charge transport layer, and an overcoat positioned on said charge transport layer, wherein said process comprises: a) adding and reacting a prepolymer comprising a reactive group selected from the group consisting of hydroxyl, carboxylic acid and amide groups, a melamine formaldehyde crosslinking agent, an acid catalyst, and an alcohol-soluble small molecule to form an overcoat solution; and b) subsequently providing said overcoat solution onto said charge transport layer to form an overcoat layer.

Phenolic overcoat compositions comprising a phenolic resin and a triarylamine hole transport molecule are known. These phenolic overcoat compositions can be cured to form a crosslinked structure.

Disclosed in U.S. Pat. No. 4,871,634 is an electrostatographic imaging member containing at least one electrophotoconductive layer. The imaging member comprises a photogenerating material and a hydroxy arylamine compound represented by a certain formula. The hydroxy arylamine compound can be used in an overcoat with the hydroxy arylamine compound bonded to a resin capable of hydrogen bonding such as a polyamide possessing alcohol solubility.

Disclosed in U.S. Pat. No. 4,457,994 is a layered photosensitive member comprising a generator layer and a transport layer containing a diamine type molecule dispersed in a polymeric binder, and an overcoat containing triphenyl methane molecules dispersed in a polymeric binder.

The disclosures of each of the foregoing patents are hereby incorporated by reference herein in their entireties. The appropriate components and process aspects of the each of the foregoing patents may also be selected for the present compositions and processes in embodiments thereof.

BACKGROUND

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image on the non-illuminated areas. This electrostatic latent image may then be developed to form a visible image by depositing finely divided electroscopic marking particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Although excellent toner images may be obtained with multilayered belt or drum photoreceptors, it has been found that as more advanced, higher speed electrophotographic copiers, duplicators, and printers are developed, there is a greater demand on print quality. The delicate balance in charging image and bias potentials, and characteristics of the toner and/or developer, must be maintained. This places additional constraints on the quality of photoreceptor manufacturing, and thus on the manufacturing yield.

Imaging members are generally exposed to repetitive electrophotographic cycling, which subjects the exposed charged transport layer or alternative top layer thereof to mechanical abrasion, chemical attack and heat. This repetitive cycling leads to gradual deterioration in the mechanical and electrical characteristics of the exposed charge transport layer. Physical and mechanical damage during prolonged use, especially the formation of surface scratch defects, is among the chief reasons for the failure of belt photoreceptors. Therefore, it is desirable to improve the mechanical robustness of photoreceptors, and particularly, to increase their scratch resistance, thereby prolonging their service life. Additionally, it is desirable to increase resistance to light shock so that image ghosting, background shading, and the like is minimized in prints.

Providing a protective overcoat layer is a conventional means of extending the useful life of photoreceptors. Conventionally, for example, a polymeric anti-scratch and crack overcoat layer has been utilized as a robust overcoat design for extending the lifespan of photoreceptors. The conventional formulation generally comprises a (i) a polyol binder, (ii) a melamine-formaldehyde curing agent, and (iii) a hole transport material coated from a solution using one or more alcohol solvents such as dowanol and/or isopropanol. In conventional formulations, Silclean 5705 leveling agent, commercially available from BYK Chemicals, is sometimes added with the objective of improving the coating properties of the solution and/or coating quality of the final protective overcoat layer.

However, the conventional overcoat layer formulation exhibits ghosting and background shading in prints. Improving light shock resistance will provide a more stable imaging member resulting in improved print quality.

Despite the various approaches that have been taken for forming imaging members, there remains a need for improved imaging member design, to provide improved imaging performance and longer lifetime, reduce human and environmental health risks, and the like.

SUMMARY

This disclosure addresses some or all of the above described problems and also provides materials and methods for reduced light shock of electrophotographic photoreceptors. This is generally accomplished by using a protective overcoat layer having a surface treated tin oxide particle filler.

In an embodiment, the present disclosure provides a photoreceptor having a protective overcoat layer comprised of:

a polyol binder;

a hole transport material;

a curing agent; and a surface-treated tin oxide particle filler.

In another embodiment, the present disclosure provides a process for forming a photoreceptor comprising providing a photoreceptor substrate;

applying a charge generating layer;

applying a charge transport layer; and applying a protective overcoating layer over the substrate;

wherein the protective overcoat layer comprises a polyol binder; a hole transport material; a curing agent; and a surface-treated tin oxide particle filler.

In another embodiment, the present disclosure provides a method of forming an image, comprising:

applying a charge to a photoreceptor comprising at least a substrate, a charge generating layer, and a charge transport layer;

exposing the photoreceptor to electromagnetic radiation;

developing a latent image formed by exposing the photoreceptor to the electromagnetic radiation to form a visible image; and transferring the visible image to a print substrate;

wherein the protective overcoat layer comprises a polyol binder; a hole transport material; a curing agent; and a surface-treated tin oxide particle filler.

The present disclosure also provides electrophotographic image development devices comprising such electrophotographic imaging members. Also provided are imaging processes using such electrophotographic imaging members

DETAILED DESCRIPTION

Figure 1:
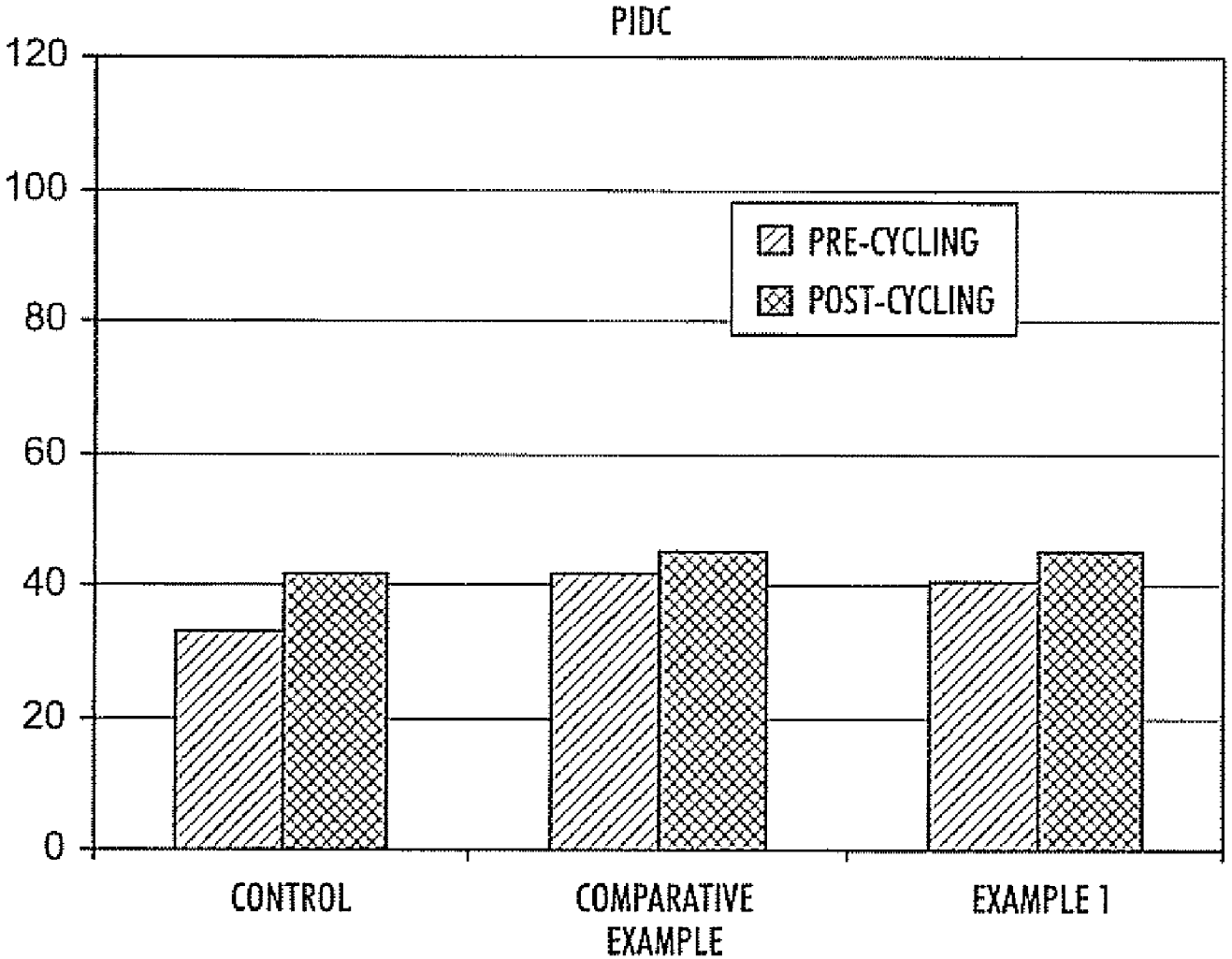
FIG. 1 is a graph of PIDC (Photo-Induced Discharge Curve) data for photoreceptors of the Example and Comparative Example of the disclosure.

The present disclosure relates generally to photoconductive imaging members such as photoconductors, photoreceptors and the like, for example which may be used in electrophotographic or xerographic imaging processes. The photoconductive imaging members have a protective overcoat formulation that leads to reduced light shock, so as to minimize ghosting, shading, and the like during printing. The formulation comprises a (i) polyol binder, (ii) a melamine-formaldehyde curing agent, a (iii) hole transport material; and (iv) surface treated tin oxide particle filler. The inclusion of surface treated tin oxide particles significantly reduces light shock while maintaining similar electrical properties and LCM performance as compared to conventional overcoat formulations having no such surface treated tin oxide.

The photoconductive imaging members are, in embodiments, multilayered photoreceptors that comprise a substrate, an optional conductive layer, an optional undercoat layer, an optional adhesive layer, a charge generating layer, a charge transport layer, and a protective overcoat layer.

Electrophotographic imaging members are known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a hole or charge transport layer is formed on the charge generation layer, followed by an optional overcoat layer. This structure may have the charge generation layer on top of or below the hole or charge transport layer. In embodiments, the charge generating layer and hole or charge transport layer can be combined into a single active layer that performs both charge generating and hole transport functions.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be about 20 angstroms to about 750 angstroms, such as about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

Illustrative examples of substrates are as illustrated herein, and more specifically layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide, or aluminum arranged thereon, or a conductive material inclusive of aluminum, chromium, nickel, brass, or the like. The substrate may be flexible, seamless, or rigid, and may have a number of different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example polycarbonate materials commercially available as MAKROLON®, a polycarbonate resin having a weight average molecular weight of from about 50,000 to about 100,000, commercially available from Farbenfabriken Bayer A.G., or similar resin.

The thickness of the photoconductor substrate layer depends on many factors, including economical considerations, electrical characteristics, number of layers, components in each of the layers, and the like, thus this layer may be of substantial thickness, for example over about 3,000 microns, and more specifically the thickness of this layer can be from about 1,000 to about 3,000 microns, from about 100 to about 1,000 microns or from about 300 to about 700 microns, or of a minimum thickness. In embodiments, the thickness of this layer is from about 75 microns to about 300 microns, or from about 100 to about 150 microns.

A charge blocking layer or hole blocking layer may optionally be applied to the electrically conductive surface prior to the application of a photogenerating layer. When desired, an adhesive layer may be included between the charge blocking layer, the hole blocking layer or interfacial layer and the photogenerating layer Usually, the photogenerating layer is applied onto the blocking layer and a charge transport layer or plurality of charge transport layers are formed on the photogenerating layer. This structure may have the photogenerating layer on top of or below the charge transport layer.

The hole blocking layer can be, for example, comprised of from about 20 weight percent to about 80 weight percent, and more specifically, from about 55 weight percent to about 65 weight percent of a suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent and, more specifically, from about 5 weight percent to about 15 weight percent of a phenolic compound containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM™ 29159 and 29101 (available from OxyChem Company), and DURITE™ 97 (available from Borden Chemical); formaldehyde polymers with ammonia, cresol and phenol, such as VARCUM™ 29112 (available from OxyChem Company); formaldehyde polymers with 4,4'-(1-methylethylidene)bisphenol, such as VARCUM™ 29108 and 29116 (available from OxyChem Company); formaldehyde polymers with cresol and phenol, such as VARCUM™ 29457 (available from OxyChem Company), DURITE™ SD-423A, SD-422A (available from Borden Chemical); or formaldehyde polymers with phenol and p-tert-butylphenol, such as DURITE™ ESD 556C (available from Border Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of substrate may be selected.

The optional hole blocking or undercoat layers for the imaging members of the present disclosure can contain a number of components including known hole blocking components, such as amino silanes, doped metal oxides, TiSi, a metal oxide like titanium, chromium, zinc, tin and the like; a mixture of phenolic compounds and a phenolic resin or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene) bisphenol), P (4,4'-(1,4-phenylene diisopropylidene) bisphenol), S (4,4'-sulfonyldiphenol), and Z (4,4'-cyclohexylidenebisphenol); hexafluorobisphenol A (4,4'-(hexafluoro isopropylidene)diphenol), resorcinol, hydroxyquinone, catechin, and the like.

In embodiments, a suitable known adhesive layer can be included in the photoconductor. Typical adhesive layer materials include, for example, polyesters, polyurethanes, and the like. The adhesive layer thickness can vary and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As optional adhesive layers usually in contact with or situated between the hole blocking layer and the photogenerating layer, there can be selected various known substances inclusive of copolyesters, polyamides, poly(vinyl butyral), poly (vinyl alcohol), polyurethane and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

The photogenerating layer in embodiments is comprised of, for example, about 60 weight percent of Type V hydroxygallium phthalocyanine or chlorogallium phthalocyanine, and about 40 weight percent of a resin binder like poly (vinyl chloride-co-vinyl acetate) copolymer, such as VMCH (available from Dow Chemical). Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium. The photogenerating, pigment can be dispersed in a resin binder similar to the resin binders selected for the charge transport layer, or alternatively no resin binder need be present. Generally, the thickness of the photogenerating layer depends on a number of factors, including the thicknesses of the other layers and the amount of photogenerating material contained in the photogenerating layer. Accordingly, this layer can be of a thickness of, for example, from about 0.05 micron to about 10 microns, and more specifically, from about 0.25 micron to about 2 microns when, for example, the photogenerating compositions are present in an amount of from about 30 to about 75 percent by volume, The maximum thickness of this layer in embodiments is dependent primarily upon factors, such as photosensitivity, electrical properties and mechanical considerations. The photogenerating layer binder resin is present in various suitable amounts, for example from about 1 to about 50, and more specifically, from about 1 to about 10 weight percent, and which resin may be selected from a number of known polymers, such as poly (vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The photogenerating layers may also comprise inorganic pigments of crystalline selenium and its alloys; Group II to VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques; and a number of phthalocyanines, like a titanyl phthalocyanine, titanyl phthalocyanine Type V; oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal free phthalocyanine and the like with infrared sensitivity photoreceptors exposed to low-cost semiconductor laser diode light exposure devices.

In embodiments, examples of polymeric binder materials that can be selected as the matrix for the photogenerating layer are illustrated in U.S. Pat. No. 3,121,006, the disclosure of which is totally incorporated herein by reference. Examples of binders are thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, poly (phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrite copolymers, poly(vinyl chloride), vinyl chloride and vinyl acetate copolymers, acrylate copolymers, alkyd resins, cellulosic film formers, poly(amideimide), styrenebutadiene copolymers, vinylidene chloride-vinyl chloride copolymers, vinyl acetate-vinylidene chloride copolymers, styrene-alkyd resins, poly(vinyl carbazole), and the like. These polymers may be block, random or alternating copolymers.

The coating of the photogenerating layer in embodiments of the present disclosure can be accomplished with spray, dip or wire-bar methods such that the final dry thickness of the photogenerating layer is as illustrated herein, and can be, for example, from about 0.01 to about 30 microns after being dried at, for example, about 40° C. to about 150° C. for about 15 to about 90 minutes. More specifically, photogenerating layer of a thickness, for example, of from about 0.1 to about 30, or from about 0.5 to about 2 microns can be applied to or deposited on the substrate, on other surfaces in between the substrate and the charge transport layer, and the like. The photogenerating composition or pigment is present in the resinous binder composition in various amounts. From about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 10 percent by volume of the photogenerating pigment is dispersed in about 90 percent by volume of the resinous binder composition.

Various suitable and conventional known processes may be used to mix, and thereafter apply the photogenerating layer coating mixture, like spraying, dip coating, roll coating, wire wound rod coating, vacuum sublimation, and the like. For some applications, the photogenerating layer may be fabricated in a dot or line pattern. Removal of the solvent of a solvent-coated layer may be effected by any known conventional techniques such as oven drying, infrared radiation drying, air-drying and the like.

The charge transport layer may comprise hole transporting small molecules dissolved or molecularly dispersed in a film forming electrically inert polymer such as a polycarbonate. In embodiments, "dissolved" refers, for example, to forming a solution in which the small molecule is dissolved in the polymer to form a homogeneous phase; and "molecularly dispersed in embodiments" refers, for example, to hole transporting molecules dispersed in the polymer, the small molecules being dispersed in the polymer on a molecular scale. Various hole transporting or electrically active small molecules may be selected for the charge transport layer or layers. In embodiments, hole transport refers, for example, to hole transporting molecules such as a monomer that allows the free charge generated in the photogenerating layer to be transported across the transport layer.

In embodiments, the hole transporting small molecule can be a substituted biphenyl diamine represented by the following general formula:

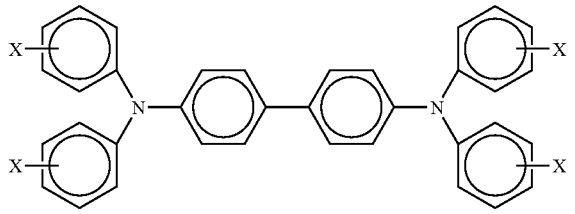

such as N,N,N'N'-tetra(4-methylphenyl)-(1,1'-biphenyl)-4,4'-diamine, wherein each X is independently selected from the group consisting of —H, —OH, alkyl (—$C_nH_{2n+1}$) where n is from 1 to about 10 such as from 1 to about 5 or from 1 to about 6, aralkyl, and aryl groups, the aralkyl and aryl groups having, for example, from about 5 to about 30, such as about 6 to about 20, carbon atoms. Suitable examples of aralkyl groups include, for example, —$C_nH_{2n}$-phenyl groups where n is from 1 to about 5 or from 1 to about 10. Suitable examples of aryl groups include, for example, phenyl, naphthyl, biphenyl, and the like. Alkyl contains for example, from 1 to about 25 carbon atoms, from 1 to about 16 carbon atoms, from 1 to about 10 carbon atoms, or from 1 to about 6 carbon atoms, such as methyl, ethyl, propyl, butyl, pentyl, heptyl, hexyl, dodecyl, and the like.

Further examples of hole transporting molecules include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, or mixtures thereof. Additional specific examples of a hole transport molecule encompassed herein may further include a tetra[p-tolyl] biphenyldiamine also referred to as N,N,N'N'-tetra(4-methylphenyl)-(1,1'-biphenyl)-4,4'-diamine; N,N,N'N'-tetra(4-ethylphenyl)-(1,1'-biphenyl)-4,4'-diamine; N,N,N'N'-tetra (4-propylphenyl)-(1,1'-biphenyl)-4,4'-diamine; N,N,N'N'-tetra(4-butylphenyl)-(1,1'-biphenyl)-4,4'-diamine and the like. If desired, the hole transport material in the charge transport layer may comprise a polymeric hole transport material or a combination of a small molecule hole transport material and a polymeric hole transport material.

In embodiments, at least one charge transport layer is comprised of at least one hole transport component of the above-mentioned formulas/structures. The concentration of the hole transport component may be low to, for example, achieve increased mechanical strength and LCM resistance in the photoconductor. In embodiments the concentration of the hole transport component in the charge transport layer may be from about 10 weight percent to about 65 weight percent and more specifically from about 35 to about 60 weight percent, or from about 45 to about 55 weight percent.

Examples of the binder materials selected for the charge transport layer include components, such as those described in U.S. Pat. No. 3,121,006, the entire disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly (cyclo olefins), epoxies, and random or alternating copolymers thereof; and more specifically, polycarbonates such as poly(4,4'-isopropylidene-diphenylene)carbonate (also referred to as bisphenol-A-polycarbonate), poly(4,4'-cyclohexylidinediphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, electrically inactive binders are comprised of polycarbonate resins with a molecular weight of from about 20,000 to about 100,000, such as a molecular weight $M_w$ of from about 50,000 to about 100,000. Generally, the transport layer contains from about 10 to about 75 percent by weight of the hole transport material, and more specifically, from about 35 percent to about 50 percent of this material.

The thickness of the charge transport layer in embodiments is from about 5 to about 90 micrometers, but thicknesses outside this range may in embodiments also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported through itself to selectively discharge a surface charge on the surface of the active layer.

A number of processes may be used to mix and thereafter apply the charge transport layer coating mixture to the photogenerating layer. Typical application techniques include spraying, dip coating, roll coating, wire wound rod coating, and the like. Drying of the charge transport deposited coating may be effected by any suitable conventional technique such as oven drying, infrared radiation drying, air drying, and the like.

An overcoat layer is formed over the charge transport layer. This protective overcoat layer may increase the extrinsic life of a photoreceptor device and may maintain good printing quality or deletion resistance when used in an image forming apparatus.

A composition for forming a protective overcoat layer is provided that comprises a polyol binder; a hole transport material; a curing agent; and a surface-treated tin oxide particle filler.

Different classes of binders that contain pendent functional groups capable of cross linking could be used. For example, functionalized polycarbonates, polyesters, and polyacrylates could be suitable binders. The crosslinking group could be comprised of but not limited to hydroxyl, epoxide, and isocyanates. Commercially available binders that meet these characteristics include the hydroxyalkyl functioned polyester Desmophen 800, available from Bayer, and the hydroxyalkyl functionalized polyacrylate Joncryl 587, available from BASF. Other specific suitable polymer binders may include, but are not limited to, polypropylene glycols (such as, for example, PPG 2000), acrylic polyols (such as, for example, 7558B-60 from OPC Polymers, Joncryl 510 or Joncryl 517 from Johnson Polymers), and the like.

The binder for the overcoat layer may include one or more of thermoplastic and thermosetting resins such as polyamide, polyurethane, polyvinyl acetate, polyvinyl butyral, polysiloxane, polyacrylate, polyvinyl acetal, phenylene oxide resins, terephthalic acid resins, phenoxy resin, epoxy resin, acrylonitrile copolymer, cellulosic film former, poly(amideimide) and the like. These polymers may block, random or alternating copolymers. The polymer binder such as polyvinylbutyral (PVB) may provide a desired rheology for coating, and may improve the coating quality of the overcoat film.

In embodiments, the binder may be a polyester polyol, such as a highly branched polyester polyol. By "highly branched" is meant a prepolymer synthesized using a significant amount of trifunctional alcohols, such as triols, to form a polymer having a significant number of branches off of the main polymer chain. This is distinguished from a linear prepolymer that contains only difunctional monomers, and thus little or no branches off of the main polymer chain. As used herein, "polyester polyol" is meant to encompass such compounds that include multiple ester groups as well as multiple alcohol (hydroxyl) groups in the molecule, and which can include other groups such as, for example, ether groups and the like. In embodiments, the polyester polyol can thus include ether groups, or can be free of ether groups.

Optionally, the formulation may further comprise a co-binder (such as Desmophen-1652A from Bayer or PolyPropylene Glycol PPG2000). Such a co-binder may have similar reactivity to the main binder. Incorporating such a co-binder may provide additional mechanical performance so as to, for example, allow fine tuning of the mechanical properties of the photoreceptor for optimal performance.

It has been found that such polyester polyols provide improved results when incorporated as a binder in the overcoating layer, particularly when combined with the hole transporting molecule. Specifically, the polyester polyols provide hard binder layers, but which layers remain flexible and are not prone to crack formation.

Examples of such suitable polyester polyols include, for example, polyester polyols formed from the reaction of a polycarboxylic acid such as a dicarboxylic acid or a tricarboxylic acid (including acid anhydrides) with a polyol such as a diol or a triol. In embodiments, the number of ester and alcohol groups, and the relative amount and type of polyacid and polyol, can be selected such that the resulting polyester polyol compound retains a number of free hydroxyl groups, which can be used for subsequent crosslinking of the material in forming the overcoating layer binder material. For example, suitable polycarboxylic acids include, but are not limited to, adipic acid ($COOH[CH_2]_4COOH$), pimelic acid ($COOH[CH_2]_5COOH$), suberic acid ($COOH[CH_2]_6COOH$), azelaic acid ($COOH[CH_2]_7COOH$), sebasic acid ($COOH[CH_2]_8COOH$), and the like. Suitable polyols include, but are not limited to, difunctional materials such as glycols or trifunctional alcohols such as triols and the like, including propanediols ($HO[CH_2]_3OH$), butanediols ($HO[CH_2]_4OH$), hexanediols ($HO[CH_2]_6OH$), glycerine ($HOCH_2CHOHCH_2OH$), 1,2,6-Hexane triol ($HOCH_2CHOH[CH_2]_4OH$), and the like.

In embodiments, the suitable polyester polyols are reaction products of polycarboxylic acids and polyols and can be represented by the following formula (1): $[CH_2R_aCH_2]_m[CO_2R_bCO_2]_n[CH_2R_cCH_2]_p[CO_2R_dCO_2]_q$ (1) where Ra and Rc independently represent linear alkyl groups or branched alkyl groups derived from the polyols, the alkyl groups having from 1 to about 20 carbon atoms; Rb and Rd independently represent alkyl groups derived from the polycarboxylic acids, the alkyl groups having from 1 to about 20 carbon atoms; and m, n, p, and q represent mole fractions of from 0 to 1, such that n+m+p+q=1.

Specific commercially available examples of such suitable polyester polyols include, for example: the DESMOPHEN® series of products available from Bayer Chemical, including the DESMOPHEN® 800, 1110, 1112, 1145, 1150, 1240, 1262, 1381, 1400, 1470, 1630, 2060, 2061, 2062, 3060, 4027, 4028, 404, 4059, 5027, 5028, 5029, 5031, 5035, and 5036 products; the SOVERMOL® series of products available from Cognis, including the SOVERMOL® 750, 805, 815, 908, 910, and 913 products; and the HYDAGEN® series of products available from Cognis, including the HYDAGEN® HSP product; and mixtures thereof. In embodiments, for example, are DESMOPHEN® 800 and SOVERMOL® 750, or mixtures thereof. DESMOPHEN® 800 is a highly branched polyester bearing hydroxyl groups, having an acid value of .1toreq.4 mg KOH/g, a hydroxyl content of about 8.6.+−.0.3%, and an equivalent weight of about 200. DESMOPHEN® 800 corresponds to the above formula (1) where the polymer contains 50 parts adipic acid, 10 parts phthalic anhydride, and 40 parts 1,2,6-hexanetriol, where $Rb=[CH_2]_4$, n=0.5, $Rd=-1,2-C_6H_4$, q=0.1, $Ra=Rc=CH_2[CHO][CH_2]_4$, and m+p=0.4. DESMOPHEN® 1100 corresponds to the above formula (1) where the polymer contains 60 parts adipic acid, 40 parts 1,2,6-hexanetriol, and 60 parts 1,4-butanediol, where Rb=Rd=$[CH_2]_4$, n+q=0.375, Ra=$CH_2[CHO][CH_2]_4$, m=0.25, Rc=$[CH_2]_4$, and p=0.375. SOVERMOL® 750 is a branched polyether/polyester/polyol having an acid value of less than or equal to 2 mg KOH/g, and a hydroxyl value of 300-330 ma KOH/g.

Examples of the polyol used for obtaining a crystalline polyester include ethylene glycol, diethylene glycol, triethylene glycol, 1,2-propylene glycol, 1,3-propylene glycol, 1,4-butanediol, 1,4-butanediol, neopentyl glycol, 1,5-pentaneglycol, 1,6-hexaneglycol, 1,4-cyclohexanediol, 1,4-cyclohexanedimethanol, dipropylene glycol, polyethylene glycol, polypropylene glycol, polytetramethylene glycol, bisphenol A, bisphenol Z and hydrogenated bisphenol A.

Polyhydric alcohols used for obtaining an amorphous polyester may be, for example, an aliphatic, alicyclic or aromatic alcohol, and examples thereof include, but are not limited to, 1,5-pentanediol, 1,6-hexanediol, 1,4-cyclohexanediol, 1,4-cyclohexane-dimethanol, dipropylene glycol, polyethylene glycol, polypropylene glycol, polytetramethylene glycol, bisphenol A, bisphenol Z and hydrogenated bisphenol A.

Further polyols usable in the present disclosure are compounds having no addition-polymerizable unsaturated group and having two or more hydroxyl groups within one molecule. Out of these compounds, the diol is a compound having two hydroxyl groups within one molecule, and examples thereof include ethylene glycol, propylene glycol, butanediol, diethylene glycol, hexanediol, cyclohexanediol, octanediol, decanediol and dodecanediol. Examples of the polyol other than the diol include glycerin, pentaerythritol, hexamethylolmelamine, hexaethylolmelamine, tetramethylolbenzoguanamine and tetraethylolbenzoruanamine. One of these polyhydric alcohols may be used alone, or two or more thereof may be used in combination.

In other embodiments, the binder can include an acrylated polyol. Suitable acrylated polyols can be, for example, the reaction products of propylene oxide modified with ethylene oxide, glycols, triglycerol and the like. Suitable acrylated polyols can be represented by the formula:

$$[R_t—CH_2]_t—[—CH_2—R_a—CH_2]_p—[—CO—R_b—CO—]_n—[—CH_2—R_c—CH_2]_p—[—CO—R_d—CO—]_q$$

where $R_1$, represent $CH_2CR_1CO$— where $R_1$ is an alkyl group; t represents mole fractions of acrylated sites from 0 to 1; Ra and Rc independently represent linear alkyl or alkoxy groups or branched alkyl or alkoxy groups derived from polyols; Rb and Rd independently represent alkyl or alkoxy groups; and m, n, p, and q represent mole fractions of from 0 to 1, such that n+m+p+q=1.

In still further embodiments, the binder may include a polyether polyol represented by the formula:

$$—[—CH_2—R_a—CH_2]_m—[—CO—R_b—CO—]_n—[—CH_2—R_c—CH_2]_p—[—CO—R_d—CO—]_q$$

where Ra and Rc independently represent linear alkyl or alkoxy groups or branched alkyl or alkoxy groups derived from polyols; Rb and Rd independently represent alkyl or alkoxy groups; and m, n, p, and q represent mole fractions of from 0 to 1, such that n+m+p+q=1.

In embodiments, the overcoat layer may be comprised of from about 1 wt. % to about 50 wt. % polymer binders, such as from about 1 wt. % to about 25 wt. % polymer binders or from about 5 wt % to about 20 wt % polymer binders or such as from about 1 wt % to about 15 wt % polymer binders, of the overcoat coating composition.

Any suitable hole transport material may be utilized in the overcoating layer. However, to provide one or more desired benefits including resistance to cracking, desired mechanical properties, resistance to image deletion, and the like, embodiments may include a tertiary aromatic amine or a hydroxyl-containing hole transport compound as a hole transporting molecule.

In embodiments, the substituted biphenyl diamine can be represented by the following general formula:

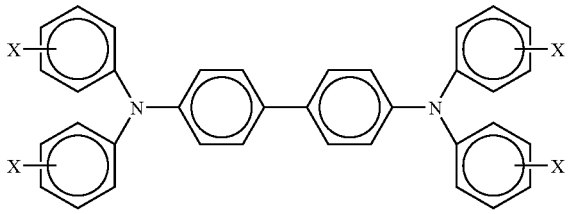

such as N,N,N'N'-tetra(4-methylphenyl)-(1,1'-biphenyl)-4,4'-diamine, wherein each X is independently selected from the group consisting of —H, —OH, alkyl (—$C_nH_{2n+1}$) where n is from 1 to about 10 such as from 1 to about 5 or from 1 to about 6, aralkyl, and aryl groups, the aralkyl and aryl groups having, for example, from about 5 to about 30, such as about 6 to about 20, carbon atoms. Suitable examples of aralkyl groups include, for example, —$C_nH_{2n}$-phenyl groups where n is from 1 to about 5 or from 1 to about 10. Suitable examples of aryl groups include, for example, phenyl, naphthyl, biphenyl, and the like. Alkyl contains for example, from 1 to about 25 carbon atoms, from 1 to about 16 carbon atoms, from 1 to about 10 carbon atoms, or from 1 to about 6 carbon atoms, such as methyl, ethyl, propyl, butyl, pentyl, heptyl, hexyl, dodecyl, and the like.

Examples of hole transporting molecules, include, for example, pyrazolines such as 1-phenyl-3-(4'-diethylamino styryl)-5-(4"-diethylamino phenyl)pyrazoline, aryl amines such as N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole, stilbenes, and the like. However, in embodiments to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency and transports them across the charge transport layer with short transit times includes N,N'-diphenyl-N,N'-bis(3-methylphenyl)-(1,1'-biphenyl)-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, tetra[p-tolyl] biphenyldiamine also referred to as N,N,N'N'-tetra(4-methylphenyl)-(1,1'-biphenyl)-4,4'-diamine; N,N,N'N'-tetra (4-ethylphenyl)-(1,1'-biphenyl)-4,4'-diamine; N,N,N'N'-tetra(4-propylphenyl)-(1,1'-biphenyl)-4,4'-diamine; N,N,N'N'-tetra(4-butylphenyl)-(1,1'-biphenyl)-4,4'-diamine and the like, or mixtures thereof. If desired, the hole transport material in the charge transport layer may comprise a polymeric hole transport material or a combination of a small molecule hole transport material and a polymeric hole transport material.

Yet further exemplary specific substituted biphenyl diamines having the above formulae may include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4"-diamine, and the like. Other known charge transport layer molecules can be selected, reference for example, U.S. Pat. Nos. 4,921,773 and 4,464,450, the disclosures of which are totally incorporated herein by reference.

The substituted biphenyl diamine may be of high quality, such as N,N,N'N'-tetra(4-methylphenyl)-(1,1'-biphenyl)-4,4'-diamine, such that, when incorporated into a photoreceptor, the photoreceptor will exhibit an improved rate of discharge of its surface potential as well as improved cycling stability. As used herein, the term "cycling stability" refers to lack of change in electrical characteristics during electrophotographic cycling. Improving discharge rate is advantageous because high speed printing applications require a shorter expose to development time within which the photoreceptor must discharge its surface potential. Therefore, photoreceptors exhibiting an improved discharge rate are important in high speed printing applications and the like, and may reduce the overall costs associated with large-scale or commercial printing operations. In embodiments, the photoreceptor may discharge from about 85% to about 100% of its surface potential in from about 0 to about 40 milliseconds upon being subjected to xerographic charging and exposure to radiant energy of from about 1 erg/cm$^2$ to about 5 ergs/cm$^2$, such as from about 85% to about 100% of its surface potential in from about 0 to about 40 milliseconds of being subjected to xerographic charging and exposure to radiant energy of about 1 erg/cm$^2$ to about 4 ergs/cm$^2$. As used herein, "high quality" referring to the substituted biphenyl diamine thus refers to a substituted biphenyl diamine that, when incorporated into a photoreceptor, the photoreceptor will discharge from about 90% to about 100% of its surface potential in from 0 to about 40 milliseconds upon being subjected to xerographic charging and exposure to radiant energy of about 1 ergs/cm$^2$ to about 3 ergs/cm$^2$. In embodiments, a photoreceptor comprising the high quality substituted biphenyl diamine may have a post erase voltage of from about 0 to about 10 volts, from an initial charging voltage of from about 400 to about 1000 volts, when erase energy is about 200 ergs/cm$^2$. The substituted biphenyl diamine may also exhibit stable xerographic cycling over 10,000 cycles.

Exemplary hydroxyl-containing hole transport compounds include those of the following formula:

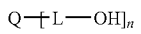

wherein Q represents a charge transport component, L represents a divalent linkage group, and n represents a number of repeating segments or groups such as from 1 to about 8.

Any suitable charge transport compound can be used as the moiety

Q. For example, suitable charge transport compounds include amines, such as tertiary arylamines, pyrazolines, hydrazones, oxaliazoles, stilbenes, and mixtures thereof.

More specifically, in embodiments, Q is represented by the following general formula

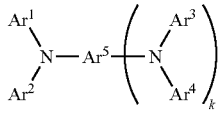

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least one of $Ar^1$, $Ar^2$, $Ar^3$ and $Ar^4$ is connected to the linkage group L.

For example, in embodiments, $Ar^1$, $Ar^2$, $Ar^3$, $Ar^4$ and $Ar^5$ each independently represents a substituted or unsubstituted aryl group, such as

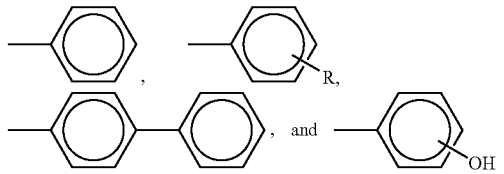

where R is selected from the group consisting of an alkyl group having 1 to about 10 carbon atoms, such as —$CH_3$, —$C_2H_5$, —$C_3H_7$, and —$C_9H_9$, or $Ar^5$ independently represents a substituted or unsubstituted arylene group, such as

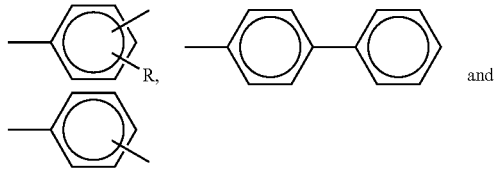

where R is selected from the group consisting of an alkyl group having 1 to about 10 carbon atoms, such as —$CH_3$, —$C_2H_5$, —$C_3H_7$, and —$C_4H_9$. Other suitable groups for $Ar^5$, when k is greater than 0, include:

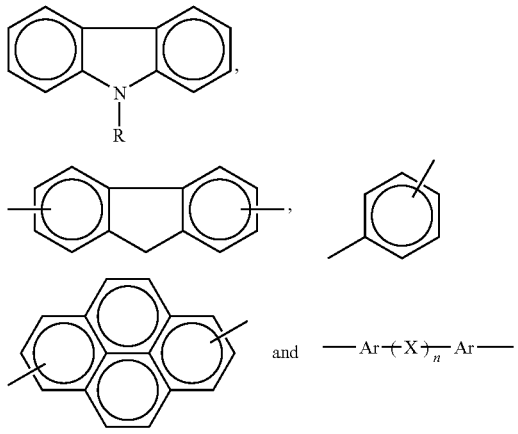

where n is 0 or 1, Ar is any of the group defined above for $Ar^1$, $Ar^2$, $Ar^3$, $Ar^4$ and $Ar^5$, and X is selected from the group consisting of:

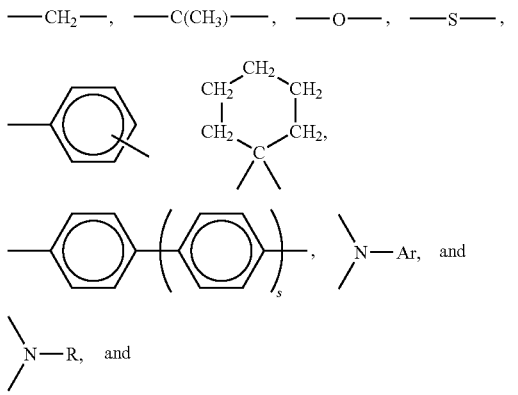

where s is 0, 1 or 2.

Exemplary charge transport compounds include the following

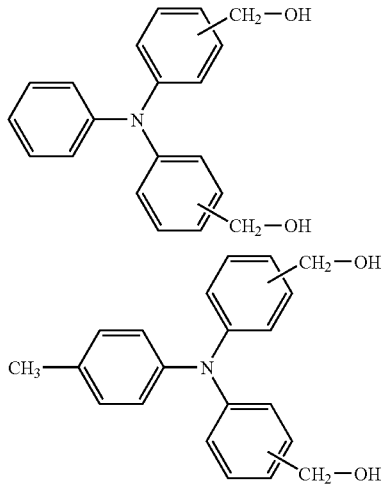

-continued

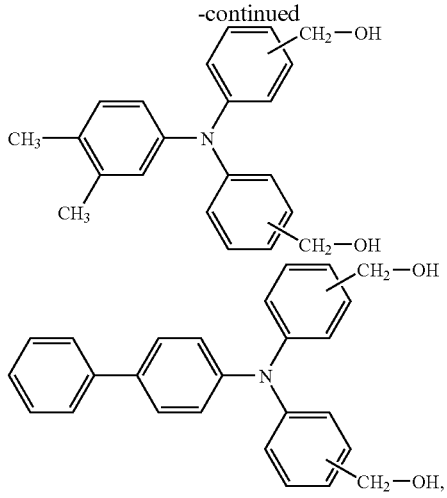

and their methyl ether derivatives.

In embodiments, the overcoat layer may be comprised of from about 3 wt. % to about 80 wt. % hole transport molecule, for example from about 3 wt. % to about 40 wt. % of the overcoat layer.

In embodiments, an optional curing agent may be selected from the group consisting of a melamine-formaldehyde resin, a guanamine formaldehyde resin, a masked isocyanate compound or resin, and an epoxide resin.

In embodiments, the overcoat layer comprises surface-treated tin oxide particles. Any suitable surface treated tin oxide particles can be used, and many varieties are known and available in the art. Such surface treated tin oxides can be used alone, as only one type of material, or can be used in combination, such as two or more different types of surface treated tin oxides, such as where tin oxide particles are separately surface treated with different surface treatment agents. Surface treatment agents may include, for example, organochlorosilanes, organosilane ethers or their titanium analogs. The surface treatment agent(s) may be represented by the general formula (I)

$$R\text{-}Z(X)_nY_{3-n} \quad (I)$$

wherein R and X each independently represents an alkyl group, an aryl group, a substituted alkyl group or a substituted aryl group. Z represents silicon atom, titanium atom and the likes. Y represents a hydrogen atom, a halogen atom, a hydroxyl group, an alkoxy group, and an allyl group.

In further embodiments, the surface treatment agent(s) may also be represented by the general formula (II)

$$R\text{—}Si(X)_nY_{3-n} \quad (II)$$

wherein R and X each independently represents an alkyl group, an aryl group, a substituted alkyl group or a substituted aryl group, an organic group containing carbon-carbon double bond, carbon-carbon triple bond, and epoxy-group. Y represents a hydrogen atom, a halogen atom, a hydroxyl group, an alkoxy group, and an allyl group.

In embodiments, R and X may comprise alkyl groups containing from about 1 carbon atom to about 30 carbon atoms such as methyl, ethyl, propyl, iso-propyl, butyl, sec-butyl, tert-butyl, pentyl, hexyl, heptyl, octyl, dodecyl, cyclohexyl and the like, halogen substituted alkyl groups containing from about 1 to about 30 carbon atoms, such as chloromethylene, trifluoropropyl, tridecafluoro-1,1,2,2-tetrahydrooctyl and the like. R can comprise aryl groups containing from about 6 to about 60 carbon atoms such as phenyl, alkylphenyl, biphenyl, benzyl, phenylethyl, and the like; halogen substituted aryl groups containing from about 6 to about 60 carbon atoms such as chlorophenyl, fluorophenyl, perfluorophenyl and the likes; an organic group containing carbon-carbon double bond of from about 1 to about 30 carbon atoms, such as γ-acryloxypropyl group, a γ-methacryloxypropyl group and a vinyl group; an organic group containing carbon-carbon triple bond of from about 1 to about 30 carbon atoms, such as acetylenyl, and the like; an organic group containing epoxy group such γ-glycidoxypropyl group and β-(3,4-epoxycyclohexyl)ethyl group and the like.

In embodiments, Y may comprise a hydrogen atom, a halogen atom such as chlorine, bromine, and fluorine; a hydroxyl group; an alkoxy group such as methoxy, ethoxy, iso-propoxy and the like; and an allyl group, In embodiments, surface-active agents may be selected from the group consisting of methyltrimethoxysilane, ethyltrimethoxysilane, methyltriethoxysilane, propyltrimethoxysilane, octyltrimethyoxysilane, trifluoropropyltrimethoxysilane, tridecafluoro-1,1,2,2-tetrahydrooctyltrimethoxysilane, p-tolyltrimethoxysilane, phenyltrimethoxysilane, phenylethyltrimethoxysilane, benzyltrimethoxysilane, diphenyldimethoxysilane, dimethyldimethoxysilane, diphenyldisilanol, cyclohexylmethyldimethoxysilane, vinyltrimethoxysilane, 3-glycidoxyproplytrimethoxy-silane, 3-(trimethoxysilyl) propylmethacrylate, and mixtures thereof.

In embodiments, the metal oxide particles may also be surface-attached with a cyclic siloxane of formula (III)

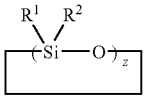

(III)

wherein $R^1$ and $R^2$ each independently represents an alkyl group of from about 1 to about 30 carbon atoms, an aryl group of from about 6 to about 60 carbon atoms, a substituted alkyl group or a substituted aryl group of from about 1 to about 30 carbon atoms, z represents an integer of from about 3 to about 10.

In embodiments, cyclic siloxane may be selected from a group consisting of hexamethylcyclotrisiloxane, 2,4,6-trimethyl-2,4,6-triphenylcyclotrisiloxane, 2,4,6,8-tetramethyl-2,4,6,8-tetraphenylcyclotetrasiloxane, hexaphenylcyclotrisiloxane, octamethylcyclotetrasiloxane, octaphenylcyclotetrasiloxane, and 2,4,6,8-tetramethyl-2,4,6,8-tetravinylcyclotetrasiloxane.

The surface treatment of the tin oxide particles can be conducted by mixing tin oxide particles with the desired surface treatment agent. Generally, the surface treatment can be performed in an organic solvent followed by suitable mixing, such as by sonication. Suitable solvents include, but are not limited to, hydrocarbon of C6 to C60, cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like. If necessary or desired, the dispersion can be further heated at an elevated temperature. Upon removal of the solvent, the surface treated tin oxide particles can be dried at elevated temperatures, such as about 150° C.

The surface treated tin oxide particles can be of any suitable size to provide desired effects. In embodiments, the surface treated tin oxide particles may have an average particle size of from about 1 nm to about 50 μm, such as from about 10 nm to about 500 nm or from about 100 nm to about 250 nm. The foregoing size measurements can be measured by, for instance, transmission electron microscopy (TEM) or calculated (assuming spherical particles) from a measurement of the gas absorption, or BET. BET value may range from about 10 to about 100 $m^2/g$ such as from about 20 to about 60 $m^2/g$.

The surface treated tin oxide particles are generally present in the overcoating composition in an amount of from about 0.1 to about 20 percent by weight of total solids in the overcoating composition. For example, the surface treated tin oxide particles can be present in the overcoating composition in an amount of from about 1 to about 10 percent, or from about 2 to about 7 or from about 3 to about 5 percent by weight of total solids in the overcoating composition. Where two different types of surface treated tin oxide particles are used, the ratio of the two types can be any desired ratio, ranging from 1:99 to 99:1. Of course, each of the size, amount, and ratio of surface treated tin oxide particles can be outside of these ranges, if desired.

In embodiments, any other suitable metal oxide particle may be used. Examples of suitable metal oxide particles include aluminum oxide (alumina), titanium oxide (dioxide) (titania)$_7$ zinc oxide and iron oxide. Further examples include silicon oxide, cerium oxide, chromium oxide, zirconium oxide, magnesium oxide, manganese oxide, nickel oxide, copper oxide, indium tin oxide. Mixtures of metal oxides may also be used.

Other organic particles may also be used, such as PTFE particles. Other inorganic non-oxide particles may also be used, such as silicone carbide or boron nitride. The tin oxide may also be doped with a heavy metal such as antimony or indium.

In embodiments, the overcoat layer comprises surface-treated tin oxide particles. Surface treatment of tin oxide is conducted by mixing tin oxide particles with a surface treatment agent, such as 3,3,3-trifluoroproyltrimethoxyysilane, in an organic solvent followed by sonication. The resulting dispersion is further heated at an elevated temperature. Upon removal of the solvent, the surface treated tin oxide particles are dried at elevated temperatures, such as about 150° C.

If desired or necessary, a blocking agent can also be included. A blocking agent can be used to "tie up" or block the acid effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents such as Cycat 4040 available from Cytec Ind.

Any suitable alcohol solvent may be employed for the film forming polymers. Typical alcohol solvents include, for example, butanol, propanol, methanol, 1-methoxy-2-propanol, and the like and mixtures thereof. Other suitable solvents that can be used in forming the overcoating layer solution include, for example, tetrahydrofuran, monochlorobenzene, and mixtures thereof. These solvents can be used in addition to, or in place of, the above alcohol solvents, or they can be omitted entirely. However, in some embodiments, higher boiling alcohol solvents should be avoided, as they can interfere with the desired cross-linking reaction. For example, the solvent system can be comprised of individual solvents (e.g., dowanol, IPA, water, or other organic solvents) or mixtures of solvents.

Examples of solvents that can be selected for use as coating solvents for the overcoat layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, 1-butanol, amyl alcohol, 1-methoxy-2-propanol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, and the like.

The resin dispersion may be obtained by known or conventional methods, such as by polycondensing a polycondensable monomer (composition) having a composition comprising (a) a polyvalent acid monomer having no addition-polymerizable unsaturated group and/or a derivative thereof in an amount of 10 to 80 mol % based on all monomers, (b) a polyhydric alcohol monomer having no addition-polymerizable unsaturated group in an amount of 10 to 80 mol % based on all monomers, and (c) a monomer having a carboxyl group and an addition-polymerizable unsaturated group and/or a derivative thereof in an amount of about 0.5 to 20 mol % based on all monomers, to obtain a polyester having an addition-polymerizable unsaturated group at the terminal, and addition-polymerizing the addition-polymerizable unsaturated group of the polyester.

The thickness of the overcoat layer selected depends upon the abrasiveness of the charging (bias charging roll), cleaning (blade or web), development (brush), transfer (bias transfer roll), and the like in the system employed, and can be continuous and may have a thickness of less than about 50 micrometers, for example from about 0.1 micrometers to about 50 micrometers, for example from about 0.1 micrometers to about 15 micrometers. Various suitable and conventional methods may be used to mix, and thereafter apply the overcoat layer coating mixture to the photogenerating layer. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging and should not have too high a free carrier concentration. Free carrier concentration in the overcoat increases the dark decay.

The overcoat layer can comprise the same components as the charge transport layer wherein the weight ratio between the charge transporting small molecule and the suitable electrically inactive resin binder is less, such as for example, from about 0/100 to about 60/40, or from about 20/80 to about 40/60.

In embodiments, the overcoat layer is prepared by any suitable technique, such as mixing all of the components together. In particular, surface treatment of tin oxide is conducted by mixing tin oxide particles with a surface treatment agent, such as 3,3,3-trifluoroproyltrimethysilane, in an organic solvent, followed by sonication of the mixture. The resulting dispersion is further heated at an elevated temperature. After removal of the solvent, the surface treated tin oxide particles are dried at elevated temperatures, such as about 150° C.

The overcoat layer coating mixture is then applied to the photoreceptor by any suitable application technique, such as spraying dip coating, roll coating, wire wound rod coating, and the like. The deposited overcoat layer may be dried by any suitable technique, such as oven drying, infrared radiation drying, and the like. The reaction between the hole transport compound comprising two or more hydroxymethyl substituents and the polyol binder to form the crosslinked overcoat layer may occur when drying the deposited overcoat layer.

The following Examples are being submitted to illustrate embodiments of the present disclosure. These Examples are intended to be illustrative only, and are not intended to limit the scope of the present disclosure. Also, parts and percentages are by weight unless otherwise indicated. Comparative Examples and data are also provided.

EXAMPLES

Example 1

Surface treated tin oxide particles are prepared by mixing tin oxide particles with 3,3,3-trifluoroproyltrimethysilane, in toluene. The resulting dispersion is subjected to sonication with heating at an elevated temperature. Upon removal of the toluene solvent, the resultant surface treated tin oxide particles are dried at about 150° C.

A protective overcoat layer coating solution is produced by mixing together 0.6 grams of methoxymethyl butoxymethyl melamine, 0.75 grams Desmophen 800, 0.25 grams Desmophen 1652A, 0.8 grams of N-(3,4-dimethylphenyl)-N,N-bis-(4-hydroxymethylenephenyl)amine, 0.2 grams of an 8% p-toluenesulfonic acid solution, and the tin oxide particles surface treated with 3,3,3-trifluoroproyltrimethysilane. The loading of the surface treated tin oxide particles is 3 percent by weight of total solids in the coating solution.

An overcoated imaging member sheet or belt is formed using the thus-prepared coating composition of Example 1. In particular, an electrophotographic imaging member web stock is prepared by providing a 0.02 micrometer thick titanium layer coated on a biaxially oriented polyethylene naphthalate substrate (Kadalex, available from ICI Americas, Inc.) having a thickness of 3.5 mils (89 micrometers) and applying thereto, using a gravure coating technique and a solution containing 10 grams gamma aminopropyltriethoxy silane, 10.1 grams distilled water, 3 grams acetic acid, 684.8 grams of 200 proof denatured alcohol and 200 grams heptane. This layer is then allowed to dry for 5 minutes at 135° C. in a forced air oven. The resulting blocking layer has an average dry thickness of 0.05 micrometer measured with an ellipsometer.

An adhesive interface layer is then prepared by applying with extrusion process to the blocking layer a wet coating containing 5 percent by weight based on the total weight of the solution of polyester adhesive (Mor-Ester 49,000, available from Morton International, Inc.) in a 70:30 volume ratio mixture of tetrahydrofuran:cyclohexanone. The adhesive interface layer is allowed to dry for 5 minutes at 135° C. in a forced air oven. The resulting adhesive interface layer has a dry thickness of 0.065 micrometer The adhesive interface layer is thereafter coated with a photogenerating layer. The photogenerating layer dispersion is prepared by introducing 0.45 grams of Iupilon 200 (PC-Z 200) available from Mitsubishi Gas Chemical Corp and 50 ml of tetrahydrofuran into a 4 oz. glass bottle. To this solution is added 2.4 grams of hydroxygallium phthalocyanine and 300 grams of ⅛ inch (3.2 millimeter) diameter stainless steel shot. This mixture is then placed on a ball mill for 20 to 24 hours. Subsequently, 2.25 grams of PC-Z 200 is dissolved in 46.1 gm of tetrahydrofuran, then added to this OHGaPc slurry. This slurry is then placed on a shaker for 10 minutes. The resulting slurry is, thereafter, coated onto the adhesive interface by an extrusion application process to form a layer having a wet thickness of 0.25 mil. However, a strip about 10 mm wide along one edge of the substrate web bearing the blocking layer and the adhesive layer is deliberately left uncoated by any of the photogenerating layer material to facilitate adequate electrical contact by the ground strip layer that is applied later. This photogenerating layer is dried at 135° C. for 5 minutes in a forced air oven to form a dry thickness photogenerating layer having a thickness of 0.4 micrometer layer.

This coated imaging member web is simultaneously overcoated with a charge transport layer and a ground strip layer using extrusion co-coating process. The charge transport layer is prepared by introducing into an amber glass bottle a weight ratio of 1:1 N,N'-diphenyl-N,N'-bis(3-methylphenyl)-1,1'-biphenyl-4~4'-diamine, and Makrolon 5705, a polycarbonate resin having a weight average molecular weight of about 120,000 commercially available from Bayer A.G. The resulting mixture is dissolved to give a 15 percent by weight solid in 85 percent by weight methylene chloride. This solution is applied onto the photogenerator layer to form a coating which upon drying has a thickness of 29 micrometers.

The approximately 10 mm wide strip of the adhesive layer left uncoated by the photogenerator layer is coated over with a ground strip layer during the co-coating process. This ground strip layer, after drying along with the co-coated charge transport layer at 135° C. in the forced air oven for minutes, has a dried thickness of about 19 micrometers. This ground strip is electrically grounded, by conventional means such as a carbon brush contact means during conventional xerographic imaging process.

An anticurl coating is prepared by combining 8.82 grams of polycarbonate resin (Makrolon 5705, available from Bayer AG), 0.72 gram of polyester resin (Vitel PE-200, available from Goodyear Tire and Rubber Company) and 90.1 grams of methylene chloride in a glass container to form a coating solution containing 8.9 percent solids. The container is covered tightly and placed on a roll mill for about 24 hours until the polycarbonate and polyester are dissolved in the methylene chloride to form the anticurl coating solution. The anticurl coating solution is then applied to the rear surface (side opposite the photogenerator layer and charge transport layer) of the imaging member web stock, again by extrusion coating process, and dried at 135° C. for about 5 minutes in the forced air oven to produce a dried film thickness of about 17 micrometers.

The protective overcoating layer is solution is then applied to the charge transport layer, and cured at 120° C. for 2 minutes.

Comparative Example 1

A photoreceptor is manufactured in accordance with the procedure described in Example 1, except that surface treated no tin oxide particles are added to the overcoat layer coating solution.

Control:

A photoreceptor is manufactured in accordance with the procedure described in Example 1, except that the protective overcoating layer is omitted.

Electrical Testing:

The xerographic electrical properties of the above prepared photoconductors were determined by known means, such as by charging the surfaces thereof with a corona discharge source until the surface potentials, as measured by a capacitively coupled probe attached to an electrometer, attained an initial value $V_0$ of about −800 volts. After resting for 0.33 second in the dark, the charged members attained a surface potential of $V_{ddp}$, dark development potential. A feedback loop adjusts the output of the corona discharge source to hold the Vddp to −500V. The photoconductive imaging members were then exposed to light from a filtered Xenon lamp with at least a 150 watt bulb, thereby inducing a photodischarge which resulted in a reduction of surface potential to a $V_{bg}$ value, background potential. The wavelength of the incident light was 780 nanometers, and the exposure energy of the incident light varied from 0 to 25 ergs/cm$^2$. By plotting the surface potential against exposure energy, a photodischarge curve was constructed.

The imaging members of the Control, Comparative Example, and Example 1 are further tested for their light-shock stability in a scanner. Each photoreceptor sheet to be evaluated is mounted on a cylindrical aluminum drum substrate that is rotated on a shaft. The devices are then charmed by a scorotron mounted along the periphery of the drum. Surface potential is measured as a function of time by capacitively coupled voltage probes placed at different locations around the shaft. The probes are calibrated by applying known potentials to the drum substrate. Each photoreceptor sheet on the drum is exposed to a light source located at a position near the drum downstream from the scorotron. As the drum is rotated, the initial (pre-exposure) charging potential is measured by a voltage probe. Further rotation leads to an exposure station, where the photoreceptor device is exposed to monochromatic radiation of a known intensity. The devices are erased by a light source located at a position upstream of charging. The measurements include the charging of each photoconductor device in a constant current of voltage mode. The devices are charged to a negative polarity corona. The surface potential after exposure is measured by a second voltage probe. The devices are finally exposed to an erase lamp of appropriate intensity and any residual potential is measured by a third voltage probe. The process is repeated with the magnitude of the exposure automatically changed during the next cycle. The devices are then exposed to the broadband white erase light for 600 cycles with a total of 1.6 million erg per centimeter square. After being light shocked, all samples are immediately subjected to a field test as described above. The changes in potential at a light exposure of 3.5 ergs/cm2 before and after the devices are lightshocked are reported in percentage.

Photo induced discharge curve (PIDC), lateral charge migration (LCM), and light shock testing were carried out on devices that include a protective overcoat layer incorporating the formulation of Example 1 (including tin oxide); the protective overcoat layer incorporating the formulation of Comparative Example 1 (including no tin oxide); and a Control photoreceptor (including no overcoat layer). The results are shown in FIGS. 1 and 2.

As seen in FIG. 1, PIDC measurement results show that the post-erase residual voltage before cycling in devices using the formulation of Example 1 and the Control solution exhibit 40.8 and 41.7 Volts, respectively. Thus, adding 3% tin oxide had essentially no effect on device electrical performance. Tests on electrical cycling stability also show that both devices have the same cycling up behavior (post cycling).

Figure 2:
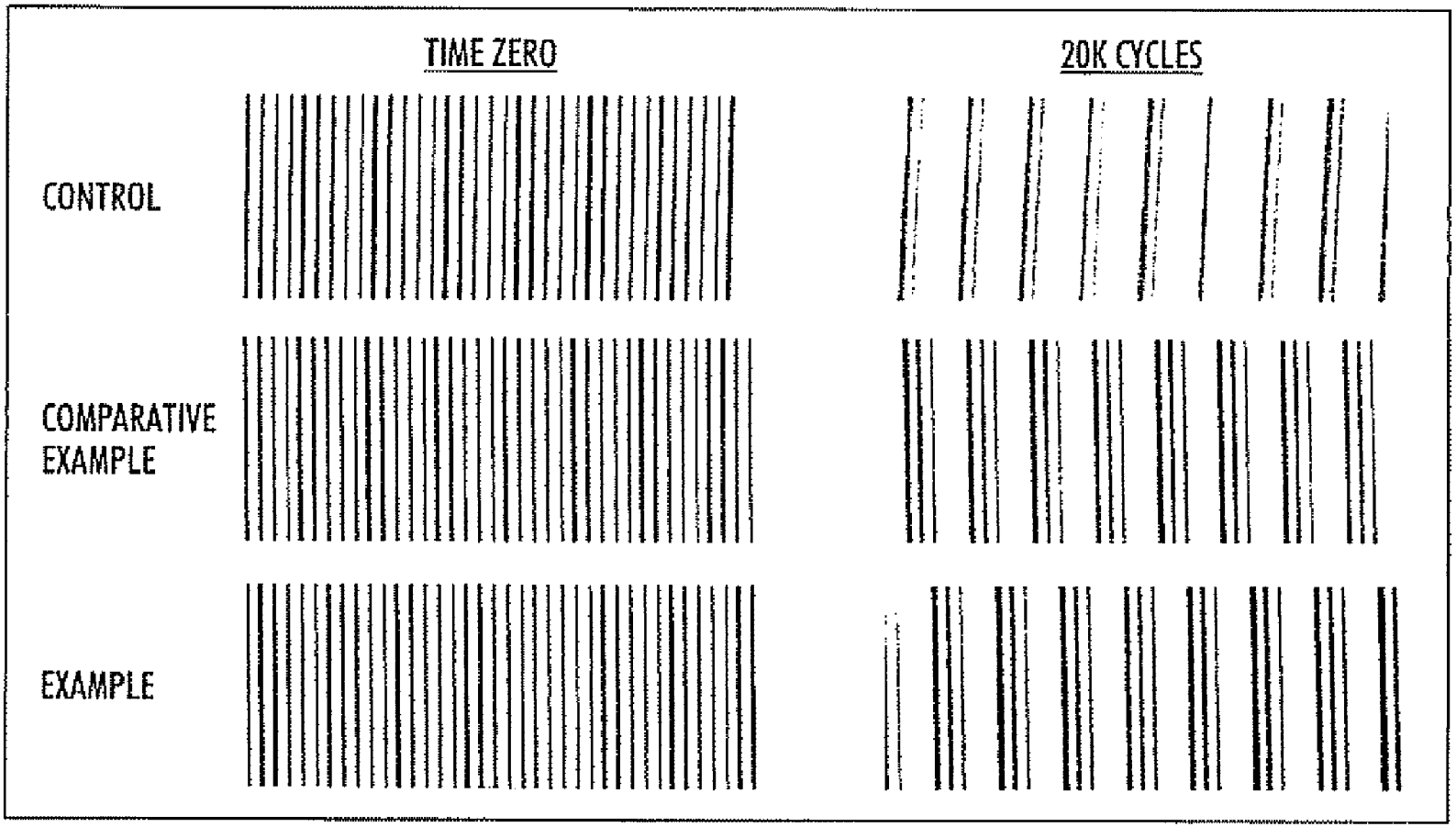
FIG. 2 is a graph showing Lateral Charge Migration (LCM) cycling stability for photoreceptors of the Example and Comparative Example of the disclosure.

As seen in FIG. 2, LCM measurements show no change in deletion after 20K cyles between the formulation of Example 1 and the Comparative Example having no tin oxide.

The device with the Comparative Example demonstrated the highest change in potential after being lightshocked (i.e., 30%), whereas the control and Comparative Example exhibit only 3-5% changes in potential due to lightshock. The addition of 3% tin oxide to the overcoat can greatly reduce the impact of lightshock to the potentials.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A photoreceptor having a protective overcoat layer comprised of:

a polyol binder selected from the group consisting of an aliphatic polyester polyol, an aromatic polyester polyol, an acrylated polyol, an aliphatic polyetherpolyol, an aromatic polyether polyol, a (polystyrene-co-polyacylate) polyol, polyvinylbutylral, poly(2-hydroxyethyl methacrylate), and a polycarbonate polyol;

a hole transport material;

a curing agent; and a surface-treated tin oxide particle filler.

2. The photoreceptor of claim 1, wherein the polyol is selected from the group consisting of:

(i) a polyester polyol represented by the formula:

$$[—CH_2—R_a—CH_2]_m—[—CO_2—R_b—CO_2—]_n—[—CH_2—R_c—CH_2]_p—[—CO_2—R_d—CO_2—]_q$$

where Ra and Rc independently represent linear alkyl groups or branched alkyl groups derived from polyols, Rb and Rd independently represent alkyl groups derived from polycarboxylic acids, and m, n, p, and q represent mole fractions of from 0 to 1, such that n+m+p+q=1, (ii) an acrylated polyol represented by the formula:

$$[R_t—CH_2]_t—[—CH_2—R_a—CH_2]_p—[—CO—R_b—CO—]_n—[—CH_2—R_c—CH_2]_p—[—CO—R_d—CO—]_q$$

where $R_t$ represent $CH_2CR_1CO_2$—, where $R_1$ is an alkyl group; t represents mole fractions of acrylated sites from 0 to 1; Ra and Rc independently represent linear alkyl or alkoxy groups or branched alkyl or alkoxy groups derived from polyols; Rb and Rd independently represent alkyl or alkoxy groups; and m, n, p, and q represent mole fractions of from 0 to 1, such that n+m+p+q=1, and (iii) a polyether polyol represented by the formula:

$$—[—CH_2—R_a—CH_2]_m—[—CO—R_b—CO—]_n—[—CH_2—R_c—CH_2]_p—[—CO—R_d—CO—]_q$$

where Ra and Rc independently represent linear alkyl or alkoxy groups or branched alkyl or alkoxy groups derived from polyols; Rb and Rd independently represent alkyl or alkoxy groups; and m, n, p, and q represent mole fractions of from 0 to 1, such that n+m+p+q=1.

3. The photoreceptor of claim 1, wherein said hole transport material is represented by the following general formula:

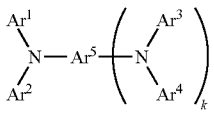

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1, wherein at least one of $Ar^1$, $Ar^2$, $Ar^3$ and $Ar^4$ comprises a hydroxyl, a hydroxymethyl group, or an alkoxymethyl group having from 2 to about 8 carbon atoms.

4. The photoreceptor of claim 1, wherein the hole transport material is selected from the group consisting of:

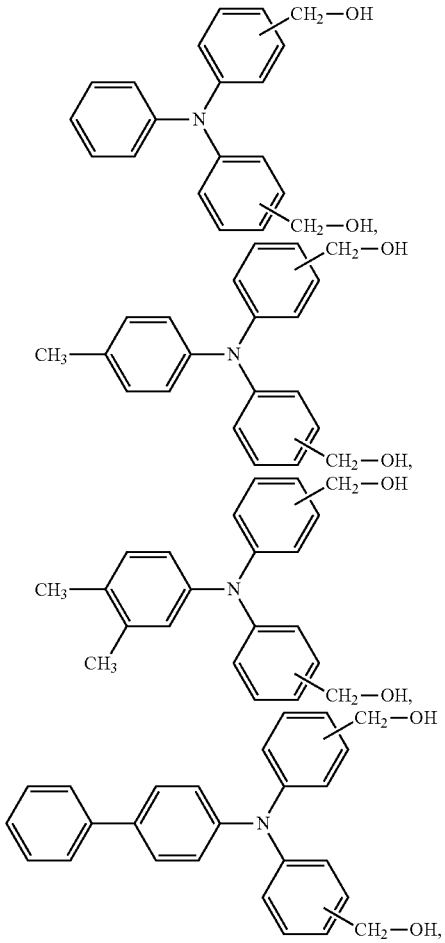

and their methyl ether derivatives.

5. The photoreceptor of claim 1, wherein the curing agent is selected from the group consisting of a melamine-formaldehyde resin, a guanamine formaldehyde resin, a masked isocyanate compound or resin, and an epoxide resin.

6. The photoreceptor of claim 1, wherein the surface-treated tin oxide particle filler is doped with a heavy metal.

7. The photoreceptor of claim 1, wherein the surface-treated tin oxide particle filler is surface treated with a silane.

8. The photoreceptor of claim 1, wherein the surface-treated tin oxide particle filler is surface treated with a compound selected from the group consisting of 3,3,3-trifluoroproyltrimethysilane, decyl trimethoxysilane (DTMS), polydimethylsiloxane (PDMS), decylsilane, and isobutyltrimethoxysilane (BTMS).

9. The photoreceptor of claim 1, wherein the surface-treated tin oxide particle filler comprises particles having an average particle size of from about 10 nm to about 500 nm.

10. The photoreceptor of claim 1, wherein the surface-treated tin oxide particle filler comprises particles having an average particle size of from about 25 nm to about 100 nm.

11. The photoreceptor of claim 1, wherein the surface-treated tin oxide particle filler comprises two different types of surface treated tin oxide particles, wherein the ratio of the two different types of surface treated tin oxide particles is from about 1:99 to about 99:1.

12. The photoreceptor of claim 1, wherein the surface-treated tin oxide particle filler is present in the protective overcoat layer in an amount of from about 0.1% to about 10% by weight.

13. The photoreceptor of claim 1, wherein the surface-treated tin oxide particle filler is present in the protective overcoat layer in an amount of from about 3% to about 5% by weight.

14. The photoreceptor of claim 1, wherein the photoreceptor layer is further doped with antimony or indium.

15. The photoreceptor of claim 1, wherein the photoreceptor has a range of resistivity between $10^3$ Ω·cm and $10^{16}$ Ω·cm.

16. The photoreceptor of claim 1, wherein the photoreceptor has a range of resistivity between $10^7$ Ω·cm and $10^{14}$ Ω·cm.

17. The photoreceptor of claim 1, wherein the overcoat layer comprises from about 25 to about 60 percent by weight of charge transport compound, from about 5 to about 50 percent by weight of polyol, from about 5 to about 70 percent by weight of curing agent, and from about 0.1 to about 10 percent by weight of surface-treated tin oxide particle filler.

18. The photoreceptor of claim 1, wherein said photoreceptor comprises in sequence:

a substrate;

a charge generating layer;

a charge transport layer; and a protective overcoat layer in contact with the charge transport layer.

19. A process for forming a photoreceptor comprising:

providing a photoreceptor substrate;

applying a charge generating layer;

applying a charge transport layer; and applying a protective overcoating layer over the substrate, wherein the protective overcoat layer comprises:

a polyol binder selected from the group consisting of an aliphatic polyester polyol, an aromatic polyester polyol, an acrylated polyol, an aliphatic polyether polyol, an aromatic polyether polyol, a (polystyrene-co-polyacylate) polyol, polyvinylbutylral, poly(2-hydroxyethyl methacrylate), and a polycarbonate polyol;

a hole transport material;

a curing agent; and a surface-treated tin oxide particle filler.

20. The process of claim 19, wherein the protective overcoating layer comprises from about 0.1% to about 10% by weight of the surface-treated tin oxide particle filler.

21. The process of claim 19, wherein the surface-treated tin oxide particle filler is surface treated with a silane.

22. A method of forming an image, comprising:

applying a charge to a photoreceptor comprising at least a substrate, a charge generating layer, a protective overcoat and a charge transport layer;

exposing the photoreceptor to electromagnetic radiation;

developing a latent image formed by exposing the photoreceptor to the electromagnetic radiation to form a visible image; and transferring the visible image to a print substrate, wherein the protective overcoat layer comprises:

a polyol binder selected from the group consisting of an aliphatic polyester polyol, an aromatic polyester polyol, an acrylated polyol, analiphatic polyether polyol, an aromatic polyether polyol, a (polystyrene-co-polyacylate) polyol, polyvinylbutylral, poly(2-hydroxyethyl methacrylate), and a polycarbonate polyol;

a hole transport material;

a curing agent; and a surface-treated tin oxide particle filler.

* * * * *